US009564113B2

(12) United States Patent
Bradfield et al.

(10) Patent No.: US 9,564,113 B2
(45) Date of Patent: Feb. 7, 2017

(54) PLIABLE ONE-PIECE SELF-ADJUSTING DUAL-MOUNT DRUMSTICK HOLDER

(71) Applicants: Graham Bradfield, Tampa, FL (US); Victor Bradfield, Bradenton, FL (US)

(72) Inventors: Graham Bradfield, Tampa, FL (US); Victor Bradfield, Bradenton, FL (US)

( * ) Notice: Subject to any disclaimer, the term of this patent is extended or adjusted under 35 U.S.C. 154(b) by 385 days.

(21) Appl. No.: 14/011,358

(22) Filed: Aug. 27, 2013

(65) Prior Publication Data

US 2014/0060285 A1 Mar. 6, 2014

Related U.S. Application Data

(60) Provisional application No. 61/695,743, filed on Aug. 31, 2012.

(51) Int. Cl.

| | |
|---|---|
| ***G10D 13/02*** | (2006.01) |
| ***G10G 7/00*** | (2006.01) |
| ***G10D 13/00*** | (2006.01) |
| ***G10G 5/00*** | (2006.01) |

(52) U.S. Cl.

CPC ..... *G10G 7/00* (2013.01); *G10D 13/003* (2013.01); *G10G 5/00* (2013.01)

(58) Field of Classification Search

CPC ..... G10D 13/003
USPC ..... 84/411 R, 421, 422.1, 422.4, 453
See application file for complete search history.

(56) References Cited

U.S. PATENT DOCUMENTS

| | | | | |
|---|---|---|---|---|
| 2,524,518 | A * | 10/1950 | D'Arcy | G10G 5/00 84/411 R |
| 4,939,972 | A * | 7/1990 | Falberg | G10D 13/02 24/514 |
| 5,117,724 | A * | 6/1992 | Gardner | G10D 13/003 206/314 |
| 5,199,621 | A * | 4/1993 | McLennan | A45F 5/00 224/223 |
| 7,687,700 | B1 * | 3/2010 | Torres | G10D 13/003 362/34 |
| D715,851 | S * | 10/2014 | Chambers | D17/99 |
| 2007/0017336 | A1 * | 1/2007 | Graham | G10D 13/003 84/421 |
| 2007/0144331 | A1 * | 6/2007 | Briggs | G10D 13/003 84/422.1 |
| 2013/0025433 | A1 * | 1/2013 | Gatti | G10D 13/003 84/422.4 |

FOREIGN PATENT DOCUMENTS

| | | | | |
|---|---|---|---|---|
| GB | 2473898 | A * | 3/2011 | G10D 13/003 |

* cited by examiner

*Primary Examiner* — Jianchun Qin

(57) ABSTRACT

Specialized functional components are formed from a single continuous one-piece pliable block. A raised main body is between laterally spaced mounting wings. Each mounting wing terminates laterally in an insertion wedge end. The exterior surface of the main body is formed with a plurality of stick slots. Each stick slot is in a curved configuration with an upwardly facing opening. The exterior surface of each mounting wing is formed with a tapered section adjacent to each insertion wedge end. The exterior surface of each mounting wing is formed with positioning lock ridges between the tapered sections and the main body.

12 Claims, 5 Drawing Sheets

PLIABLE ONE-PIECE SELF-ADJUSTING DUAL-MOUNT DRUMSTICK HOLDER

RELATED APPLICATION

The present application is based upon U.S. Provisional Application No. 61/695,743 filed Aug. 31, 2012, the subject matter of which application is incorporated herein by reference.

BACKGROUND OF THE INVENTION

Field of Invention

This invention relates to musical equipment accessories; more specifically, to a device for holding and storing drumsticks or other similarly-shaped musical accessories.

Description of the Prior Art

Drummers and other percussionists often need to readily store and retrieve drumsticks. There is often little time in which to change sticks when a drummer is playing. As such, having quick and easy access to the right stick at the right time has a profound effect on a drummer's performance and creative control. The present design provides drummers new and greatly improved ways to store and retrieve drumsticks, resulting in an improved and more creative performance.

SUMMARY OF THE INVENTION

The present invention is a superior drumstick holder. In an embodiment of the present invention, a pliable, malleable, resilient, and self-adjusting drumstick holder is presented. Its self-adjusting abilities are multiple, applying to both the manner in which sticks are held and the manner for adaptively mounting the entire holder to a drum. The drumstick holder is generally comprised of a single continuous piece. There is no separate mounting bracket, rather, the portion of the holder that acts as an anchor to mount the holder is a pliable and malleable extension of the whole, the surface of which compresses into place then expands to form a firm hold in contact with a mounting surface(s). The holder has multiple contact surfaces on multiple sides such that several surfaces are generally in contact with a mounting surface at any one time.

In an embodiment, the drumstick holder can comprise a central area of mass with thinner wing-like extensions on two sides. The central area may have a ledge of material extending forward with a space underneath it, which acts as a support member. This may be called a hoop ledge.

The central area of the mass may contain one or more shallow cavities, open areas, channels, or slots to accept and hold sticks across the body of the holder such that only part of the stick is inserted into these cavities, generally around the middle, but not exclusively, of the stick. These may be called Stick Slots. The Stick Slots can form a general U-shape, or a V-shape, but may also take other more complex shapes.

My invention incorporates several significant and unique advances into one simplified device—a device that is at the same time a much simpler device, while at the same time adding greatly to its advantages well beyond the prior art. These advances encompass and include, but are not limited to: fewer manufacturing steps, improved usability, increased durability, and simultaneously better affordability.

The present design is entirely unique in that it is one continuous piece, and may be all of the same material, which forms all the elements needed for a drumstick holder. It does not need a bracket, in the traditional sense of the word.

Furthermore, it is unique in its ability to independently self-adjust and conform to sticks and the mounting locations, whether they be on a bass drum or other locations.

ADVANTAGES: Although other drumstick holders exist, my invention is superior because it has the following advantages:

One-Piece—it is a simple one-piece design, with no additional parts, beyond the one-piece. As such, it has:

simplified manufacturing, no moving parts to come loose, no parts to detach, intentionally or unintentionally no parts to get lost, no moving parts to break, no fasteners to wear out, no threads to wear or strip, no stiff (non-flexible) parts to break under pressure, and no springs to wear out.

Silent—quieter than any other prior art drumstick holder. Great for recording. The pliable material is inherently shock absorbing, sound dissipating and vibration damping, throughout the entire holder, such that there is:

no rattle, of sticks in holder, no rattle, from holder itself—of holder's parts against each-other, no rattle, of holder against mounting location, drum or drum hardware, from holder's contact with components of drums, for example, shell, hoop, lugs, tension rods, stands, etc., no significant sound from inserting or removing sticks, no significant sound from accidental impacts against the holder during a drumming performance.

Faster—Hit It Hard and Fast: being pliable and absorbent, my invention allows drummers to insert sticks faster than any other holder. Whereas, drummers may slow down when inserting sticks into other, prior art, stick holders in order to avoid damage to themselves, the stick, the holder, or the mounting location and to help them more accurately insert the sticks, my invention both absorbs impacts, thereby tolerating and eliminating impact related concerns, and allows for easier stick insertion, as the impact force also helps channel the sticks to the correct location, even compensating for inaccuracy during stick insertion—allowable inaccuracy of stick insertion, detailed below. So, drummers can be more relaxed and more reckless using my stick holder.

Therefore, the substantial shock absorbing ability can absorb and dissipate impacts, whether from intentional hitting during stick insertion or from accidental hitting during performance. Drummers do not have to slow down as much as they would when putting a stick into other holders.

Also, unlike some stick holders that require adjustment of some sort to accommodate different stick sizes and force the drummer to take time to do so, my invention provides automatic self adjusting for different size sticks, so saves time. Healthier—across the wide array of prior art drumstick holders, they all share the common trait of having parts made of hard materials; such as metal and hard plastic. Interaction with such surfaces creates stressful impacts on a drummer's anatomy, which may contribute to health problems with extended use and repetition. Drumsticks may also become damaged. My invention solves these problems and more.

The pliable and absorbent nature of my invention provides substantial shock absorbing ability that can absorb and dissipate impacts, whether from intentional hitting during stick insertion or from accidental hitting during performance. Also, together with the shock absorbing ability, the convenient placement of the stick slots 110, ease of stick insertion and allowable inaccuracy of stick insertion, detailed below, all work together to permit drummers to use a more natural motion while inserting and removing sticks that is less stressful on a drummers hand, arm and shoulder, which make using my holder a healthier choice for drummers. Similar impacts applied to prior art drumstick holders would likely cause damage to the drummer's anatomy, holder, stick, mounting location or all four. As a result, use of my invention is beneficial to the drummer, sticks last longer, holder lasts longer and mounting location is protected.

Any Angle—Works in Any Position. Holds sticks regardless of holder's position, such that it works at all angles and orientations relative to the ground; horizontal, vertical, completely upside-down and all points in between. Since drum hoops (360) wrap all the way around a drum in a circle, my invention's ability to hold sticks at any point around the drum is very convenient and useful.

Therefore, numerous holders may be positioned all over a drum at the same time; on top and sides of both front and back, at same time—as well as underneath if drum is held above the ground, such as used in a marching band.

Sticks, stick specific advantages—One-Size Fits All popular stick sizes (all common popular stick sizes, from thin 7A jazz sticks to thick marching band sticks and everything in between). Due to its pliability and flex, it can conform to comfortably and securely hold sticks of different size simultaneously with no need for action on the part of the drummer to modify or in any way adjust the holder to do so. Stick Slots 110 are soft and pliable, such that they expand and contract to conform around individual stick sizes and shapes.

As such, my invention allows drummer to focus on playing without the distraction of making any preparatory or periodic adjustments to a stick holder to accommodate his or her individual stick preference, or changes in preference throughout a performance. Thus, a drummer may insert sticks immediately without any further concern, since the holder will adjust itself.

Automatically Adjusts Itself to Different Stick Sizes—as mentioned above, my holder is self-adjusting to instantly and automatically accommodate and firmly hold a very wide range of stick sizes, including all of the most common and popular stick sizes, without any action needed by the drummer to do so. This makes it very easy to use.

Multiple Stick Sizes Simultaneously—Holds multiple stick sizes at the same time, such that an entirely different size stick may be held in each individual stick slot on the same holder at the same time, even if the sticks are greatly different in size.

Non-Slip—The pliable material hugs the sticks and has a textured surface, so sticks will not fall out. Allows use on side of drum and upside-down. This is especially good for marching band applications.

Safe and Gentle on Sticks—Sticks do not touch each-other while in holder. Stick Slots 110 are soft so will not damage sticks and slots are vibration absorbing, shock absorbing, and vibration damping. Material of holder envelops sticks in a way that may protect them from external impacts Accidental impacts with holder's soft material do not mark or harm sticks—unlike prior art holders where an impact to any part of the holder, made of hard material, is transmitted to the sticks which are often caused to jostle and rattle.

Easy and Forgiving Stick Insertion—Sticks may be inserted using a downward vertical motion, generally from above, forward, backward, or many combinations. This description and directionality would be adapted for holder placement in other orientations. Inaccurate insertion attempts are accommodated as the pliable material is able to give way and allow off-center insertion attempts to become successful by channeling the impact force into the area of least resistance which is also where the stick is supposed to go, into the open stick slot 110.

Easy and Flexible Stick Removal—The pliable material easily relents to various angles, and amounts, of stick removal force, making it possible for a drummer to be somewhat imprecise and relaxed while easily removing a stick in numerous different directions. Thus, each individual person may choose whatever direction is most comfortable for them at the time.

Up, Down or Sideways: Furthermore, removal may be either in a generally up or down or sideways (at angles up to roughly 45 degrees) direction. While upwards may be obvious (as that is the direction of the open top of the stick slot 110), the shape and material of the holder also allow a drummer to press downward on a stick such that the stick is caused to pivot in such a way as to rotate loose of the holder and further toward the drummers hand at the same time, putting it into an ideal and ready-to-use position.

Organizes Sticks—Holds multiple sticks in a way that keeps them separated from each-other and held firmly in a consistent position and location, for easier and faster identification, selection and retrieval of different stick sizes, types or styles.

Performance Oriented—provides advantage of sticks being arrayed in a logical and sequential arrangement, lending to preparation of sticks of different types as may be applicable at progressive times throughout the sequence of a musical performance.

Scalable—such that the same design can be expanded to hold more sticks while still being one-piece and retaining all the same advantages. It may be easily adapted to hold various quantities of sticks, simply by lengthening or shortening without significant change in the design, by simply repeating (or reducing) the same features.

In other words, my invention accounts for changes in stick quantity and location without deviating from the same general design. Number of stick slots may be increased or decreased. Proximity of Stick Slots to each-other may also be modified. This is advantageous since, increased space between Stick Slots creates more space for a drummer's fingers to grasp an individual stick without bumping against an adjacent stick.

Adaptable and Individualized—adjustable stick hold tension, force/pressure and angle can be achieved simply by how far and in what manner a stick is pressed into the stick slot. The nature of the pliable material gives a drummer (user) the ability to put sticks into the holder in different ways—such as different angles, depths and at different points along the stick—to result in personally selectable hold characteristics. Since the pliable material is resilient, a user can change the way a stick is held each time they put a stick into the holder if they want to, or put it in the same way each time for consistent hold.

User Customizable/Modifiable—hold tension, force/pressure, and hold angle can be modified (personalized) by a user. The soft nature of the material permits a user to remove material to easily modify the hold characteristics; by simple trimming, cutting, shaving, or other means, using readily available means such as scissors or a hobby knife.

Customizable Stick Protrusion—No Balance Needed. Sticks in my holder do not need to be centered; that is, inserted at, or even close to, their central balance point. As such, sticks can extend (or retract) to varying distances, providing a variety of position choice and grabbing options. The firm grip of the long and continuous surface of the Stick Slots 110 (which creates large surface area friction) allow drummers the freedom to insert sticks at the far end of a stick, either end. Thus, each individual stick may be uniquely positioned for various purposes, such as; optimized ease of retrieval, to indicate stick type, purpose, appearance, or many other reasons.

Outer Stick Slots—the overall width of my holder and its orientation offers more choice in positioning sticks. This is due to how the outer stick slots are in a position that allows sticks held in them to go past the central tom drum holding support block that is common on many bass drums, that would block sticks held in narrower prior art holders. Sticks may be positioned on both sides of this support block simultaneously. As a result, those sticks may be moved further back and away from the front of the holder, thus allowing centrally located sticks in the inner slots to have more space on either side of them for easier and faster grabs.

Stick Angle is Adjustable—Selection and customization of stick angle can be achieved in several different ways:

Basic—Inherent abilities in the pliable nature of the entire holder and the continuous, from front to back, surface of the Stick Slot channels means that the Stick Slot channels may accept and hold a stick that is inserted at a diagonal angle such that the end closest to the drummer may be higher than the end further away from the drummer that may be down lower, or vice-versa. This is possible even with a very basic simple and smooth shaped stick slot. To achieve this advantage is a simple choice for each drummer—sticks can be angled up by pushing furthest area of stick deeper down into the trench of the Stick Slot while area closer to drummer is not in as deep, causing stick to be angled up. This may make grabbing and removing a stick easier for some drummers, providing more ergonomic personal choice to best match individual physical position, drum kit setup, musical style and physical comfort.

Integrated—Can be designed so that Stick Slots slope upward a bit toward front or down. Alternatively, tear-away (or add-in) portions of material could be used to modify the angle. Such as, if add-in, a piece of material inserted to block the front-most portion of the Stick Slot channel a bit to boost or tilt a stick up.

Adjustable—An enhancement of the integrated method would be material that can be raised or lowered in multiple steps. A "lift" block could be added to front so angle can be adjusted. Such blocks may attach like a puzzle piece with multiple positioning notches that mate to corresponding surfaces of the stick slots or other areas of the holder.

More—Furthermore, there are other options. The above only address the angle as it pertains directly to the Stick Slots 110 themselves. However, the entire holder may be implemented with ways to achieve height and angle changes of the entire holder which would in-turn influence the stick slots 110 therein—these are covered in their own section.

Open View for Faster More Accurate Stick Selection Provides good stick type visibility while sticks are still stored. Open nature of my holder, compared to most prior art (which use tubes to surround and hold sticks), provides drummer with view of entire length of sticks. Stick tips may be of varying nature having different musical applications, middle sections may have differing tapers while grip end may have varying surfaces. As such, it is advantageous to have good stick visibility along the entire length of a stick. The invention provides easier, quicker and more accurate identification of differing stick types for appropriate stick selection and removal. With this improved stick selection and change-over process, a drummer may apply different sticks to appropriate musical passages or applications during the course of a performance, resulting in an improved and more creative performance.

One Stick in Two Holders Simultaneously—A stick may be held by a single holder or may bridge multiple holders for additional stick position choices and even greater hold. That is, a single stick may be held by two or more of my holders at the same time, working together on the same drum, around each of the typically two hoops, on front and back hoops respectively, such that one end of a stick is held by one holder while the opposite end of the same stick is held by the other holder, on the opposite hoop, at the same time. This may be done for:

Increased stability under certain conditions, and

Low profile, to stop stick ends from protruding in situations where such may be unwanted or represent a potential obstruction or impact risk; and Appearances, to have a unique look; and Make center of stick more readily accessible for grabbing (desirable for certain percussion styles); and Packing and transport, whereby the drum may be placed into a case and store sticks alongside the drum as one unit; and Stick Slot Variety—Stick Slots have Variable Hold.

Continuous Hold Surface—The continuous nature of the pliable Stick Slots 110 is superior to more traditional designs having multiple individual stick holding clips. The clearest advantage is that sticks are held securely at lower relative holding pressures due to the high surface contact which has innumerable small contact points adding up to create a large amount of friction without pressing in too hard against a stick. This means that a stick may be held firmly, while the lack of pressure needed to do so allows easier stick removal than other holding methods.

Diagonal Options and More—another advantage stemming from the continuous hold pliable surface is the ability to easily hold sticks at various angles, passing diagonally across the long surface which conforms around the stick to hold it easily at these numerous angles. This highlights another weakness and inability of prior art holders using individual stick holding clips as these do not readily adapt to holding sticks diagonally or at any angle other than horizontal. This advantage is covered in more detail in the "Stick Angle is Adjustable" section above.

Multi-Tension Single Slots—Stick Slot variations with multiple tension, hold pressure, choices within a single stick slot are possible: A stick slot may have a single main cavity or have multiple cavities or sides with textures similar to waves or ripples down the sides such that the result would act like multiple cavities without needing to each be the full size. In essence, these waves or ripples would form multiple, partially overlapping, grip areas. Such multiple stick holding areas, however formed, within a single stick slot may be sized differently and have varying contours within a single slot in order to create selectable differing amounts of pressure on the stick, or specialized areas for certain stick sizes or types, in order to give a drummer a selection of stick holding tensions to choose from, simply by inserting a stick to the desired tension position. No mechanical adjustment would be needed.

Shapes—There are innumerable different Stick Slot shapes to choose from—This provides for many personal and individualized choices. A single Stick Holding Slot may have multiple contours to achieve different stick tensions, or areas optimized to fit and hold different sticks diameters or for different purposes within same slot. For example:

Ripple/Wave stick slots, that narrow toward the bottom, provide a user choices of multiple holding force and resistance options without any adjustment needed, e.g. no knobs etc.

Multi-cavity stick slots may have areas within a single Stick Slot to provide Stick Slot grip options whether for varying grip on same size stick or customizable grip for different stick sizes.

Parallel ripple contours, on one or each side of a single Stick Slot, result in the deeper area holding tighter due to greater material volume needing increased displacement pressure as a stick moves deeper.

Simple-V. This shape choice has the advantage of providing different tensions for the same stick and a more custom fit for different stick sizes simply by inserting sticks slightly deeper.

Many Choices on One Holder—My invention provides the opportunity to have a drumstick holder with either all stick holding slots being the same, or a mixture of different stick slot sizes and shapes all on the same holder. This is possible because each individual stick slot may be functionally isolated from others, thus a stick slot could be different without significant influence on the other stick slots on the holder. For example, a holder with four (or more) stick slots could have four different tightness stick slots across that same holder. For example:

The simplest type of mixture would be stick slots that are the same shape but of varying widths to vary holding force.

A mixture of different shapes, see above.

Outer Slots—The two outer stick slots provide further choice in variation, even if they have the same size and shape as all the other stick slots on the holder. The reason is a combination of both the outer edge and the under-cut area below having less material to press inward. Thus, the outer stick slots may be made to offer lower (or higher) holding force, simply by locating the slots closer to or further from the outside. As a result, they may have lower pressure on sticks giving a drummer the choice of multiple holding forces from the same stick holder. Thus, some sticks may be held a bit less firmly for faster removal verses others in that same holder, or, different sized sticks may be stored in varying slot tensions as desirable by each individual drummer.

Universal Mounting—Fits many drums, including all popular and common types. In use, most typically my invention would be attached to a bass drum also commonly referred to as a "kick drum". However, it may be scaled to fit onto other, both larger and smaller, drum types, such as snare, tom-tom, bongo, timbale, taiko, and numerous others. For purposes of simplicity and brevity, explanations of use in this document will be confined to a common bass drum, though a generally similar approach would be used for other drums too.

General Shape—The overall curvature, arc shape, of my holder in combination with the pliability of the material comfortably fits and conforms to the generally rounded shape of common bass drums, while also accommodating some variation therein. Due to its pliability and flex, it can conform to drums of different diameters and with different lug styles, and can adapt by flexing to other odd sizes. It easily fits the common 8-lug and 10-lug configurations.

Flex-Fit Installation—Dual sided self-compensating flex-fit installation and mounting achieves easy and secure mounting in a very simple way using the mounting wings 102. No separate mounting bracket is needed, instead, the mounting portion is simply an extension of the main body which is also the location of the stick holding portion. Once on, it stays secure due to the expansion of the wings after initial installation. Then it is further stabilized by the use of two mounting wings at opposite ends to counteract and re-enforce each-other.

Handles Various and Unusual Drum Configurations—The pliable material will conform to the wide variety of possibilities in drum design, such as varying; spaces under the tension rod, distances from hoop to lug and shapes of lugs.

Other Drums—Without any substantial modification or mechanical adjustment, my invention can also be adapted to work on other drums. This may be achieved simply by adapting the scale of the main body and mounting wings appropriately to the proportion of the general type, or size classification, of drum where it may be mounted.

Lug-Bridging: With the inclusion of lug-bridging, whereby space(s) are added to allow the holder to span across tension rod and lug group areas, thus enabling reach to and subsequent mounting using other nearby tension rod and lug groups, my invention can work on many other sizes & configurations.

Many Mounting Positioning Choices—Using the multiple sets of lug and tension rod groups (on typical bass drums), my holder may be mounted in numerous locations around each of the typically two hoops on a drum.

Lug Bridges—In addition to their use in accommodating other or odd drums (as mentioned above), lug bridges also provide more positioning choices, increased positioning and fine-tuning of basic position options when used on common size drums. Lug bridges allow my holder to bridge over lugs by using the subtraction of material along the bottom edge at various points to form cavities that a lug may recess into. Typically, two (2) such cavities would provide the best Lug Bridge (or Lug Hopper) ability, while not reducing the body material too much to weaken the overall holder. More than two lug bridges may be incorporated to provide greater variety of placement choice.

Multi-Directional Placement—The invention is multi-directional and works regardless of which way it is facing or which side of the drum it is on, front or back. Can be used against front side hoop (aka resonant side) or back side hoop (aka batter side), where drummer typically sits. While in either of these locations, can be used with hoop ledge 201 over drum hoop 360 thereby facing a hoop, or opposite, with a hoop ledge 201 facing away (in opposite direction) from drum hoop 360. However, the preferred placement would be with hoop ledge 201 actually over drum hoop 360 and to be against the batter side hoop closest to the drummer.

Fine-tunable: Position may be adjusted once holder is in generally desired location. In this way, it is not limited to a single preset or predetermined placement. It provides each drummer the choice to fine-tune placement of the holder in either typically left or right directions on drum such that the precise position may be adjusted to best suit individual preference.

Swarms—Several holders may be used on a single drum at the same time, around both the front and back, going all the way around a drum. More holders equates to more spare sticks. This is desirable for drummers who drop a lot of sticks, or for drummers who throw sticks out to an audience, in which case, having more sticks results in a more theatrical and entertaining performance. This is also desirable for drummers who use many different sticks to achieve sound and/or style variations throughout a performance. This use of many holders may also be advantageous for marching band drummers who have greater access to the entire circumference of a drum, so may use more holders. The mobile nature of marching drummers requires that any spare sticks travel with them, so having the ability to carry more sticks is good.

Minimal Packaging—My invention is unharmed by impacts, so needs only minimal packaging requirements. As a result, it saves time, money and the environment, in the following ways, it is:

Environmentally friendly—Uses zero wasteful packing materials for shipping. No padding type material needed inside shipping boxes, that is; no paper, no bubble wrap, no styrofoam, no styrofoam peanuts, absolutely no packing material of any kind. Retail packaging may also be minimal. Results in greatly reduced waste compared to prior art products.

Aside from packaging, saves fuel due to the holder's own lighter weight during transport.

Saves time with fast shipping preparation. As mentioned above, no padding type material needed inside shipping boxes. Also, no careful positioning needed in shipping boxes. Therefore, can be quickly thrown into a box in any way, in any orientation. Shipping box may also be handled quickly without regard to any risk of dropping or any other types of impacts. Saves money; again, since it does not need any protection during shipping, no money is spent on packing materials. Furthermore, retail packaging may also be minimal and, as such, less expensive.

Once again, aside from packaging, the holder's own light weight saves money by reducing freight and shipping costs.

No packaging option—It may even be displayed at retail with no packaging whatsoever, such that it may have a simple hole at one end that may be used to hang it from a typical retail display peg or prong, or a string or similar item may be looped through that hole to hang it from. All product information may be presented to a customer by being applied or printed directly on the holder itself, due to its large flat surface areas. No packaging further increases the above listed advantages related to minimal packaging.

Lower Cost—Due to its simplicity, making use of a single continuous solid material, my invention is economical and inexpensive:

Low manufacturing and production cost; easy to manufacture; few steps; only one material; fast to manufacture; less packaging, both for shipping and in-store—as it needs no protection from impacts, packaging can be minimal and may even be eliminated altogether.

Low purchase price—making it more easily affordable for drummers.

Unique Double Press-In Flex-Fit Friction Mounts—My invention has simple and reliable mounting with a unique dual-expansion design that provides fast, easy and secure installation. It pushes under drum tension rods (tuning screws) between the hoop and the lug. (There is a fairly common size gap on most popular brands and models of drums). Once in place, it is held in position simply by pressure and friction. The positioning lock ridges 130 are not essential for every situation but do assist in creating increased friction when combined with the force of the tension rod screws pressing down into the pliable material of the holder.

Simple and Easy to Use—It is compressed and then expands, once in place, to self-adjust and adapt to a wide variety of bass drum configurations, so a user does not have to be concerned with making any adjustments.

Simple to mount into position, just squeeze, press it into place, then release. Also, simple to remove, just by reversing the same steps.

No complex parts to figure out or operate. No knobs or wing-nuts to turn, no screws to tighten, no levers or latches to adjust.

No tools needed to install, to adjust or to use.

Detail of how to mount: a drummer would simply squeeze to compress a Mounting Wing 102, then insert the narrow Insertion Wedge End 120 under a tension rod on one side, using a combination of push (mostly) and pull motions. Next, repeat the process using the other Mounting Wing 102 and closest tension rod on the other side as an anchor point. Finally, an optional step is to even the sides out by extending them both in opposite directions until they are under each tension rod about equally—this can typically be achieved with a quick tug on the two outer ends.

Fast—my invention makes mounting fast. The squeeze, press it into place, then release process is quick.

There is nothing to latch, thread, screw on, turn, spin, or any other similar time consuming action to do.

The material automatically expands to create a secure mount instantly without any action from the drummer.

Fits Snug with Flex-Fit—Mounting Wings 102 create a custom fit. The pliable material of the mounting wings adjusts itself by expanding and conforming to optimize the fit and maximize the contact points for the available space of each individual drum. There are 5 points of pressure on each side, each of the two mounting wings touches: 1) drum shell, 2) tension rod, 3) drum lug, 4) hoop claw and 5) hoop—for a total of 10 contact points. Each of these points may be at slightly different locations from one drum to another, especially between different models and manufacturers. The flex-fit compensates for such variations.

Holds Securely—Dual Flex-Fit Expansion Mounting creates stability and firm hold.

Dual-Expansion Mount—Makes mounting security better. Two separate Mounting Wings 102 expand to fit tightly and grip onto two locations simultaneously. This secure mounting approach creates a strong and stable hold by using two-sided security which has opposite sides that reinforce each-other in several ways:

Create stability across the holder from side-to-side by securing opposite ends: Have twice the holding power of a single mount and automatically reinforce and compensate for any loosening on one end resulting from impacts by self tightening at the other end. See below for more detail.

Compression—While the Mounting Wings 102 use expansion, the holder also uses compression to achieve a good fit and may do both at the same time. Since the overall width between lugs may vary, my entire holder, from one end to the other including the main body 101 of my holder, may compress to create the best fit from side-to-side between the lug locations across a drum. The Main Body 101 may be compressed and thereby adjust to create a good fit while the Mounting Wings 102 are using expansion to create a good fit, all at the same time. Essentially my holder auto-adjusts itself, since a user only has to put it into the desired location and let go, such that any adjustments after that are made by the holder itself.

Locks In Place—Once put in place, the material may expand around and up both sides of each tension rod, as well as the surfaces of the lugs and hoop, at both ends of the holder and effectively locks itself into position, preventing the holder from being dislodged from its position on the drum; resisting the forces of sticks being put in and taken out of the holder as well as any other impacts or vibration.

Creates Equilibrium—The two mounting locations further work together by having equal and opposite expansions or compressions to maintain a balance between the two, resulting in good stability.

Uses No Mechanical Parts—Has no screws, nuts, bolts, wire, coil springs, clamps or similar items that may loosen, break, get lost or otherwise loose effectiveness. Thus, my invention avoids these typical weaknesses found in other prior art stick holders.

Hitting It Makes It Work Better—Impacts from the sides or above help my invention hold better, including every time a stick is inserted. In this way, using it makes it better. This is due to the combination of my invention's dual mounting system, pliable material and shape.

Auto-Reinforcing and Self-Compensating—Unintentional loosening of one Mounting Wing 102 results in tightening of the other. A force from one side that may tend to dislodge the holder from its mounting location, will result in making the other side hold stronger, and vice-versa. Thus, my invention compensates for a dislodging force with strengthened hold on the other opposite side, as the opposite mounting-wing is pressed more firmly and more securely into place. In this way, my invention has auto-reinforcing ability such that it is a self-compensating mounting device.

Arc Shape—Impacts from a generally above direction push the holder against its mounting location, and have an additional result—due to its arc shape—of also improving the hold of the Mounting Wings 102 simultaneously. This is due to the arc shape which channels the energy of impacts, including routine stick insertion, down and out to the mounting wings, pressing both of the mounting wings more firmly into their desired locations to strengthen the mounting grip.

Never Needs Removal—Never needs to be taken off. Although it is simple to remove, my drumstick holder invention can stay in place mounted on a bass drum permanently, even during transport of drums. Due to the pliable nature of the material used, it may be compressed flat for storage and transportation.

Fits in drum case—It squashes down to fit into a typical drum case together with the drum while still mounted in position on the drum.

Faster Setup Time—Actually, zero setup time, since it can stay mounted and therefore is ready to use at all times.

Protects Drum—From bumps and scratches. Provides protection from abrasion to the drum shell, drum hoop and drum head edge. In addition to providing a barrier between the sticks and the surface of the drum shell, the present invention provides a soft shock absorbing barrier that protects the drum from potentially damaging impacts, with or without sticks being in the holder, in and around the area of the holder mounting location. Therefore, it protects the drum while drum is stationary but also, protects drums from damage, including during transit, by acting as padding.

Safe for Drum Head and Drum Tuning—Has no negative effects on drumhead or head changes.

Does not influence or modify drumhead pressure/tension.

Does not interfere with drumhead changes.

May be left in position during drumhead changes.

Light Weight—Lighter than any other drumstick holder. No metal parts, combined with the porous nature, typically having air pockets) of the pliable material, mean that it is lighter than any other, prior art, drumstick holders, relative to the number of sticks it is capable of holding. It even floats.

Reliable, Durable and Tough—My holder is highly reliable and a great advance over holders with multiple parts which may be subject to; loosening, becoming lost, unsticking, breaking, metal fatigue, rust, corrosion, wear and tear. These issues with prior art are especially problematic with common smaller parts such as screws, springs, nuts, and small plastic parts. Furthermore, prior art holders that rely on multiple parts which must be exchanged for different situations, such as holding different stick sizes, may become useless if such a part is lost. My invention overcomes such limitations. It is:

Robust Stick Slots are surrounded by supporting material in both primary movement directions making them resilient. This is better than prior art holders that use various forms of thin clips to hold sticks where clips have no surrounding support and are thus vulnerable to repetitive stress related deterioration of hold integrity and subsequent failure and breakage.

Virtually unbreakable—Even if hit with a hammer or run over by a car, so it is good at surviving the rigors of a band on tour.

Resilient—Bounces; will not break if dropped or impacted in any way.

Car-proof—Can be run over by a car and will still work. Pliable material will spring back into shape after being hit or squashed.

Water resistant—Will not be damaged by moisture (when made using preferred embodiment material)

Rust proof and corrosion proof since it has no metal parts

User Customizable:

Easily customized fit for odd places and sizes—mounting wings can be physically trimmed and cut to fit especially narrow or irregularly shaped mounting locations.

Adding new stick slots—the pliable material may be soft enough to allow a drummer, purchaser or user of the product, to easily and safely cut additional stick slots into, out of, the main body at their own discretion and to meet their own individual and personal needs. Furthermore, this option would likely incur no additional cost to a person once the product had been purchased. In other words, it would be free to modify with no additional parts to purchase, adhere or attach.

Safe for Use by Children—Soft, no sharp edges and no small parts to be swallowed or choked on.

Decorative—Can be bright colors (even color coded for ownership, location, application or other ID purposes) and can be easily decorated with graphic designs. Since it is all one piece, it is easier and more cost effective to obtain uniform color or pattern.

Shock Absorbent—Pliable material results in fully integrated and inherent shock mounting and vibration damping. So impacts to the holder or its mounting location will not knock sticks out of holder.

Adapts To Various Manufacturing Choices.

Material: The holder is not dependent on any particular material, but instead, may be made from a wide range of pliable and flexible materials to achieve the similar purpose.

Manufacture Method: The method of manufacture may vary while still achieving a similar utility. It may be created using various subtractive or additive methods. For example, such diverse methods as; molding, cutting from a solid block or being formed from bonding multiple additive layers into a unified whole. Other methods may also be used.

BRIEF DESCRIPTION OF THE DRAWINGS

For a fuller understanding of the invention, reference should be made to the following detailed description, taken in connection with the accompanying drawings, in which.

DRAWINGS—REFERENCE NUMERALS

100—drumstick holder
101—main body
102—mounting wings
110—stick slots
110B—stick slots (alternate/preferred)
110C-F—stick slots (alternative shapes)
120—insertion wedge end
130—positioning lock ridges
140—side notch
200—drumstick holder, alternative and preferred embodiment
201—hoop ledge
310—drumsticks
320—drum shell
325—drum head
330—drum lug (tension rod receptacle)
340—drum tension rod (screws)
350—drum hoop claw
360—drum hoop
410—height and tilt adjustment flap
420—height and tilt flap positioning stopper

DETAILED DESCRIPTION OF THE DRAWINGS

In the following detailed description of the preferred embodiments, reference is made to the accompanying drawings, which form a part hereof, and within which are shown by way of illustration specific embodiments by which the invention may be practiced. It is to be understood that other embodiments may be utilized and structural changes may be made without departing from the scope of the invention.

Figure 1:
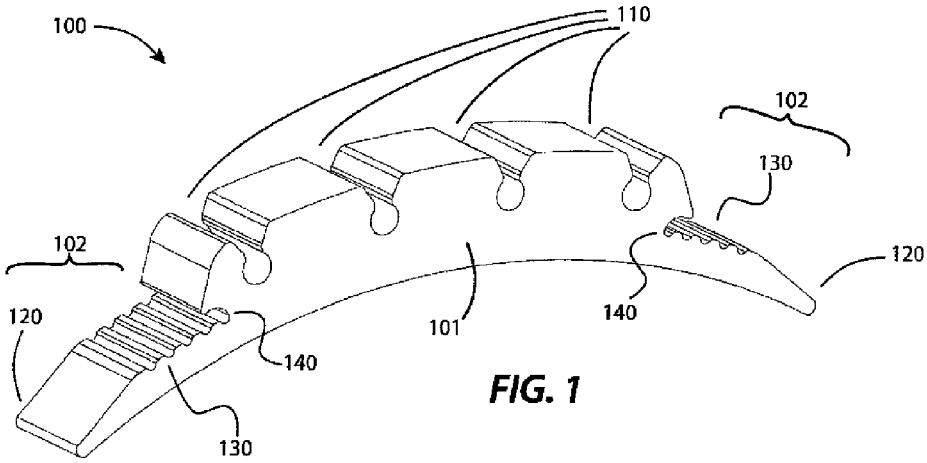
FIG. 1 is a perspective view of the drumstick holder according to an embodiment of the present invention, viewed from above left.

FIG. 1 shows an embodiment of drumstick holder 100. Drumstick holder 100 is a single continuous piece of material, one-piece, that includes main body 101, stick slots 110, and mounting wings 102, each having insertion wedge end 120, positioning lock ridges 130, ridges extend up into the side side notches 140. Although the side notches are optional, if used, they do provide a concave area to allow greater choice of fitting onto drums with closer lug spacing, while maintaining upper area of main body for stick slots. In the preferred embodiment, the side notches 140 add the ability to accommodate bass drums with 10-lug style in addition to the more common 8-lug style—since with 10 lugs they are closer, typically about 7 inches apart. Side notches 140 also provide increased lateral positioning adjustment on drums having wider lug spacing. Although positioning lock ridges 130 are optional, if used, they do provide increased grip against mounting location. Main body 101 may contain any number of stick slots 110. This embodiment 100 (shown in FIG. 1) is a basic embodiment and is fully functional.

The overhanging areas above the side notches 140 provide support to the stick slots 110 when the stick slots 110 are opened far by big sticks in the outside stick slots 110. They add support by contacting either the tension rod below it, or if no tension rod is close enough, then making contact with the material of the holder wing that is below it.

Figure 2:
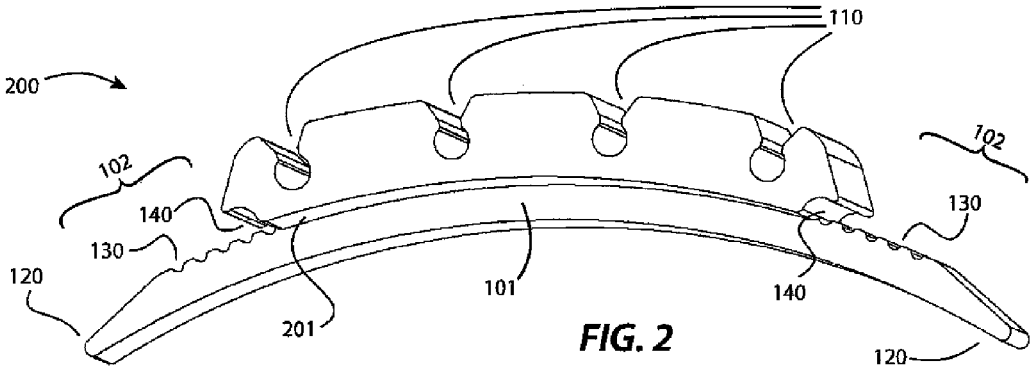
FIG. 2 is a perspective view of the drumstick holder according to an alternate embodiment of the present invention, viewed from below right. This figure shows an enhanced embodiment with respect to that of FIG. 1.
Figure 6:
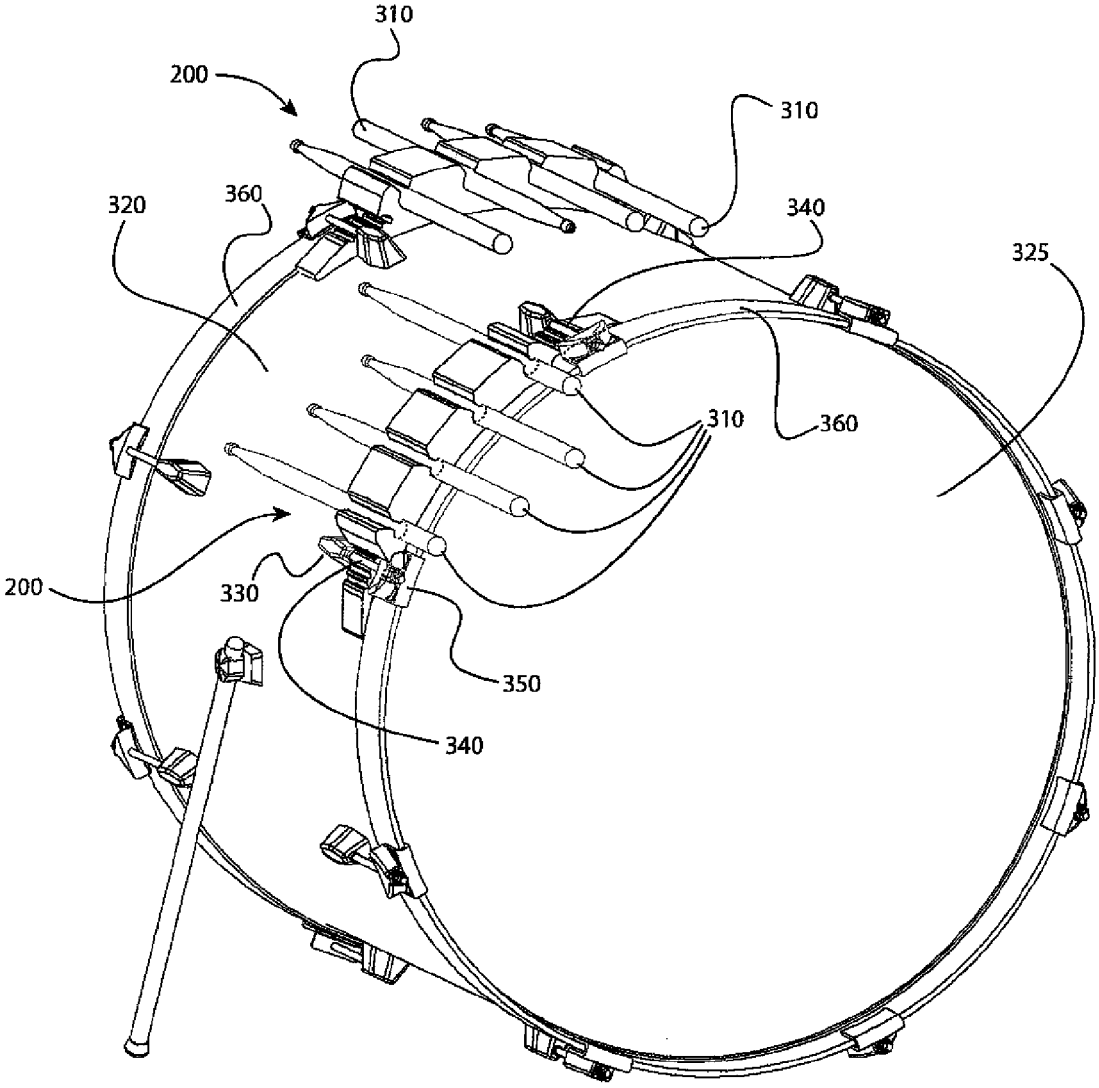
FIG. 6 is a perspective view of the drumstick holder shown with drumsticks held thereon mounted in a first arrangement and in a second arrangement mounted on a bass drum according to an embodiment of the present invention, viewed from above left.
Figure 7:
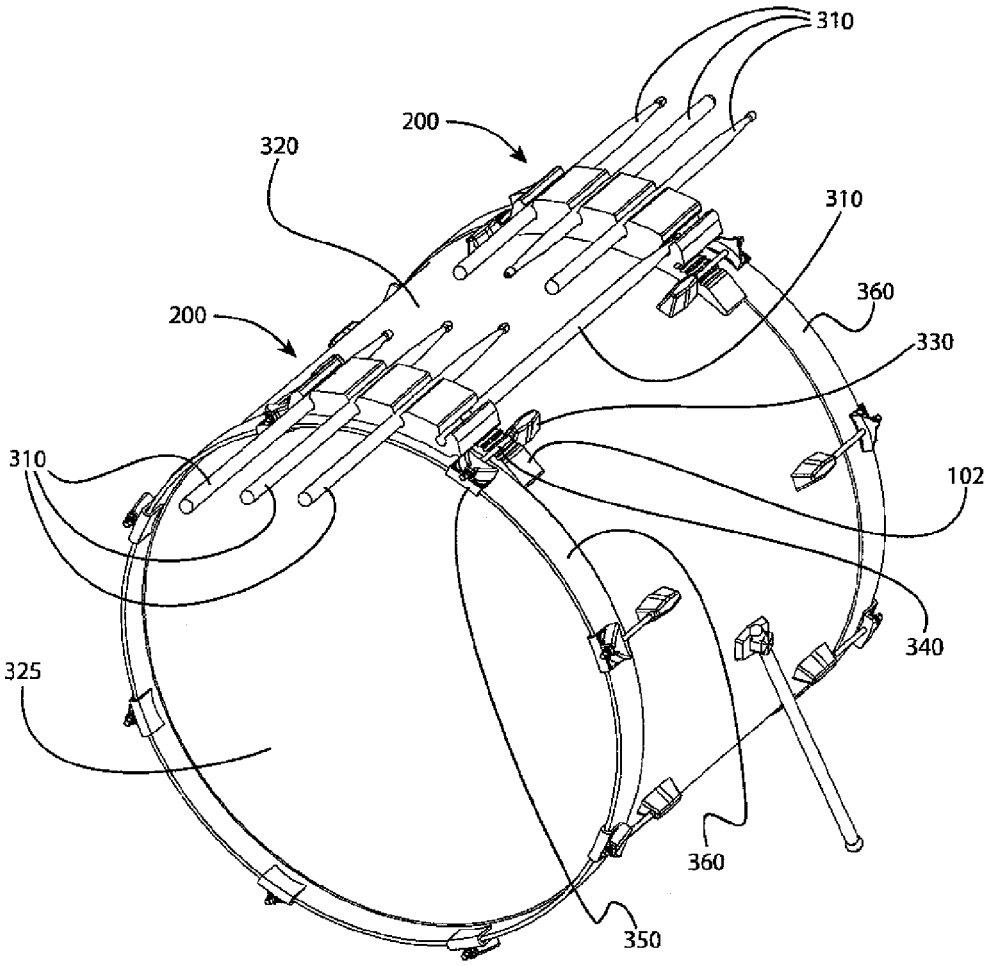
FIG. 7 is perspective view of the drumstick holder shown with drumsticks held thereon in alternate arrangements mounted in a second arrangement and in a third arrangement mounted on a bass drum according to an embodiment of the present invention, viewed from above right.

FIG. 2 shows an alternative and preferred embodiment, 200, having all the same elements as 100 with a single enhancement, whereby, the upper central area of main body 101 is simply extended forward, enlarged, a short distance thus forming hoop ledge 201 such that in application it may extend over the raised portion of the typical bass drum hoop, 360 in FIG. 6 and FIG. 7. This is also a one-piece design and may be manufactured by various methods.

FIG. 2 is an upward view, from below right to provide better perspective of extended portion, hoop ledge 201, of main body 101. This extension, hoop ledge 201, by extending the body, creates extra long stick slots for firmer stick hold. Hoop ledge 201 may also, by contact with drum hoop 360, tilt entire holder 200 up a little in front, so angle of sticks 310 is raised. This provides greater stick stability by focusing a comparatively greater proportion of stick weight back into the holder. Also, increases clearance of drummer's knees from sticks and enhances ease of grasping sticks for removal under certain circumstances for some people, as sticks are pointed in a more upward direction toward the drummer's upper body.

Figure 3:
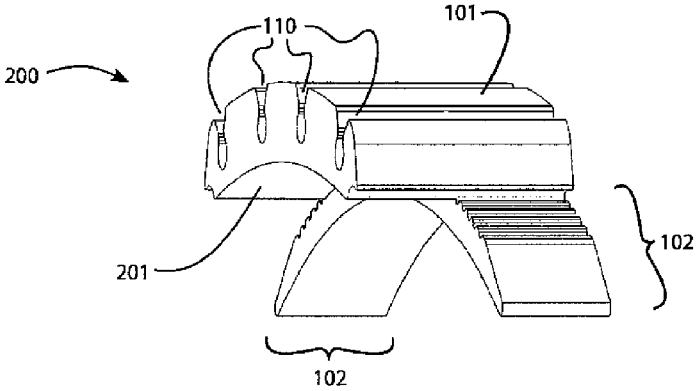
FIG. 3 is a side plan view of the drumstick holder according to an embodiment of the present invention.

FIG. 3 is a side plan view of the drumstick holder 200, according to an embodiment of the present invention. This view provides greater clarity of relationships between holder parts, especially emphasizing hoop ledge 201 and mounting wing 102. Here it may be seen more clearly how hoop ledge 201 is simply the underside cutaway of an extension or enlargement of the upper central area of main body 101, such that in embodiment 200, main body 101 is a larger area, than in embodiment 100, with hoop ledge 201 representing a cutaway area underneath part of it, generally from mounting wing(s) 102 forward.

Figure 4:
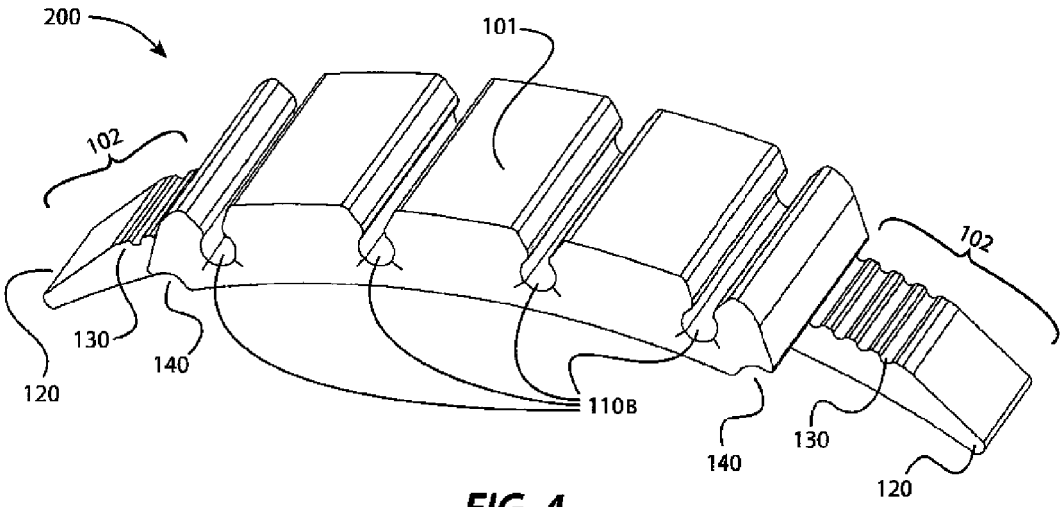
FIG. 4 is a perspective view of the drumstick holder according to an embodiment of the present invention, viewed from above right.

FIG. 4 is an above right perspective view of the drumstick holder 200 according to an embodiment of the present invention. Front is tilted down, such that hoop ledge cutout area (201), although still present, is underneath and not directly viewable. FIG. 4 provides a continuous view of the stick slots 110B from front to back of main body 101.

Any number of stick slots 110 may be incorporated into main body 101. The pliable material may conform around different areas, surfaces and contours of a stick in different ways, as the stick shape and diameter may vary, along the length of the stick slot, such that a stick can be gripped comfortably by a Stick Slot 110 or 110B, or other variations, even if the different areas of the drumstick have different thicknesses. Stick Slots 110/110B/etc are flexible, durable, and instantly and automatically self-adjust to the size of the drumstick. The pliable material surrounding these Stick Slots 110/110B/etc makes this possible. Such movement, compression/expansion and flexibility allows the Stick Slots 110/110B/etc to adapt automatically to fit a number of popular, common stick sizes and many unusual sizes as well. Stick Slots 110/110B/etc readily fit odd and hybrid sizes and those with drastic changes in diameter.

FIGS. 5A, 5B, 5C, 5D, 5E and 5F are front plan views showing several alternative embodiments and options for the shape of the Stick Slots 110 of the present invention. These could be used uniformly, each stick slot having the same shape as the one next to it, on a holder or as different embodiments mixed together on a single holder. Other shapes and styles, not all shown, are also possible. Each provides for alternate grip scenarios, different stick size handling abilities, stick tilt angles and characteristics related to inserting, removing, long-term hold and other optimizations. More shapes are possible. These are only a few examples, since the stick slots 110 may be manipulated and modified in innumerable ways.

Figure 5A:
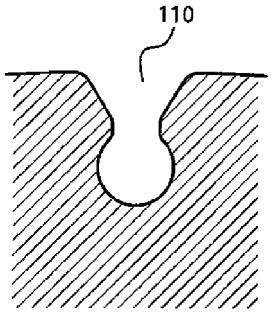
FIG. 5A through FIG. 5F are front plan views of several alternate embodiments of the stick slot 110 of the present invention.
Figure 5B:
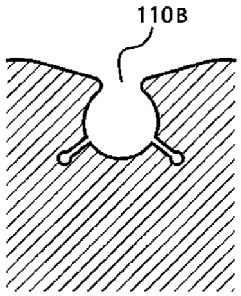

FIG. 5A shows the basic embodiment of stick slot 110. FIG. 5B shows the preferred embodiment of stick slot 110, identified as 110B. Stick holding slot 110B has multiple surfaces, contacting the stick 310, that are formed by the presence of pressure separation/expansion slits that delineate the contacting surface into at least three somewhat independently flexing surface areas (at least partially independent/partly isolated from each other), while all surfaces are still connected at a deeper level.

As a result, the bottom surface is able to move somewhat independently from the sides of the same slot 110B. Thus, compression on the bottom surface during stick 310 insertion pulls the side surfaces of slot downward to a lesser extent than the bottom surface is compressed. Since individual surfaces may compress differently at the same time without significantly influencing each other, this allows the upper area of the slot's sides to stay in their upward position, then expand partially over the upper radius of the stick 310 as it passes downward following insertion. This creates improved hold.

Figure 5C:
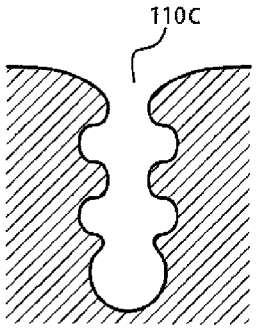

FIG. 5C may be described as a "wave" cut. This wave cut creates user selectable positions (notches) for a stick that provide different amounts of hold force, or tension, according to both shape of stick slot 110 and stick position within that stick slot, especially vertical depth into the slot, to meet an individual's personal preference. Stick holding force and thus tension increase with increased vertical depth into material whereby vertically deeper areas have increased force due to greater volume of surrounding material.

Figure 5D:
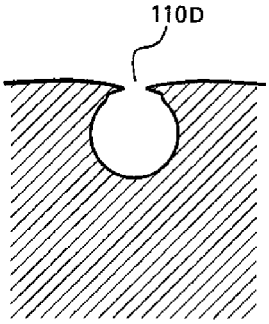

FIG. 5D depicts a shallower stick slot such that, in addition to alternative stick insertion and removal characteristics compared to other embodiments, the reduced space requirements of this shape allow that the height of the entire main body 101 may be lowered, resulting in an overall smaller drumstick holder.

Figure 5E:
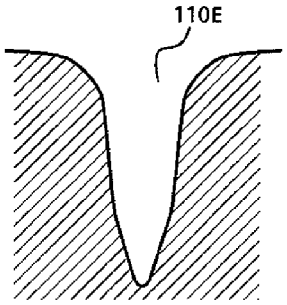

FIG. 5E may be described as a "deep-v" cut. This provides a continuously variable amount of hold together with easier entry of a stick into the Stick Slot due to the wider upper portion. Deeper in holds tighter, less-deep does not hold as much and suits different sticks and desired ease of removal. This combination, especially when further combined with an individual drummer's stick choice may be preferable for some drummers. Furthermore, the narrower bottom permits it to go deeper into the body of the material with less impact on weakening the body, as compared to styles with wider bottom cavities or chambers.

This slot shape (5E, deep-v cut) also has the added advantage of being simpler to manufacture using certain manufacturing methods. Having this increased range of manufacturing methods and the alternative manufacturing cost options, which are therefore available, is desirable and advantageous.

Figure 5F:
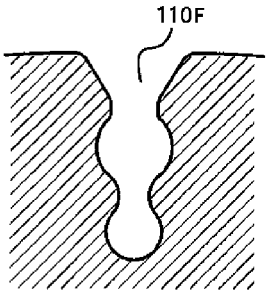

FIG. 5F provides two alternative sized chambers such that certain sticks may be held better in one or the other depending on personal preference of the drummer, stick size, stick surface finish or other factors.

FIGS. 6 and 7 are different perspective views of the drumstick holder shown with drumsticks held therein mounted in a first arrangement, second arrangement and third arrangement, more are possible, to the hoops, both front and back hoops, of a bass drum according to an embodiment of the present invention, viewed from different angles.

Drumstick holder 200 or 100 may be mounted to a number of locations as illustrated in FIGS. 6 through 7, ore are possible. For example, it attaches to the front or back (location of bass drum head 325, when viewed from an audience point of view, but may also be considered the front from the drummer's point of view, an opposite perspective), following the cylindrical contour of bass drum shell 320. Holder may be mounted under any one of the tension rods or screws 340 located around the drum, regardless of orientation or location, relative to the ground, such that it may be mounted on the top, sides or underside (if accessible, for example in the case of a suspended or carried drum as may be used for a marching band).

Though single tension rod or screw 340 mounting is possible, using two tension rods or screws 340 is preferred for greater stability. Drum tension rods or screws 340 are located between, and connect, a hoop claw 350, with a drum lug, tension rod receptacle, 330 in groups around the circumference of drum shell 320, front and back, and corresponding hoops 360.

Holder is secured to drum by inserting wedge end 120 area of mounting wings 102 underneath a tension rod 340 into the space above drum shell 320 where the tension rod connects between the lug 330 and the hoop claw 350, ideally up to where the positioning lock ridges 130 of mounting wings 102 move under tension rod to create a stronger mount. Thus, mounting wing 102 works by compressing and fitting snugly, after subsequent self expansion, into a rectangular shaped opening (or slot) created by underside of tension rod 340, outer surface of drum shell 320, front side of lug 330, back side of hoop claw 350, and optionally a portion of back side of hoop 360. And, thereby replacing all manner of clips, nuts, bolts, cams, screws, channels, hinges, springs, and all other manner of mechanical fastening devices and attachments. Furthermore, no adhesive is needed.

In this manner, pressure is exerted in at least four directions, against at least 4 surfaces, on a single mounting wing 102—that is, from drum shell 320 below, from tension rod 340 above, from lug 330 on one side, and from hoop claw 350 on the other side. Additionally, edge of drum hoop 360 may also provide an additional 5th contact surface.

After positioning of mounting wing on one side, the opposite side mounting wing 102 is optionally affixed to drum by means of a different tension rod 340 on the opposite side of the holder (using same method as with first mounting wing 102). Thereby, complimentary opposing forces are applied creating a very secure mount. In other words, the two mounting wings 102 work together to create greater stability without the need for increased thickness and bulk that would be needed to get the same stability from a single side. These two mounting locations used together create more secure hold than any prior art having single mounting locations. Furthermore, the separate mounting wings 102, being on opposite sides, complement and counterbalance the forces of each other, such that if one side is pushed in a direction that may tend toward loosening it, the other side would be thereby pushed in the direction that would tend to strengthen its hold. As a result, loosening forces from one side actually improve and increase holding forces for better mounting security on the other side.

Drumsticks 310 are shown inserted and held in stick slots 110. Sticks can be held in drumstick holder in a number of configurations, as shown in FIGS. 6 and 7. Drumsticks can be snapped or pressed into stick slots 110 at the tip-end, butt-end, middle, or anywhere in between. Individual drumsticks in drumstick holder embodiments 100 or 200 can each be positioned differently and separately, without regard to how the other stick(s) in holder 100 or 200 is/are positioned.

My invention is omnidirectional, such that it can function facing any direction, front, back, sideways, or in between. It can also function in horizontal and non-horizontal positions, for example, tilted sideways or upside-down and all positions in between. Furthermore, regardless of directionality of my holder relative to the drummer, sticks may still be inserted.

More than one drummer may share my holder, even if they are on opposite sides of the holder, such that both or more, multiple drummers, may insert and remove sticks from the holder from their respective sides of the holder. This may even be accomplished simultaneously, such that multiple drummers may insert or remove sticks at the exact same time.

Holding a stick 310 simultaneously in two of my drumstick holder inventions 200, also possible with embodiment 100, is illustrated in FIG. 7, such that one end of the stick 310 is in one holder while the opposite end is held in the other. In this way, a stick may be held such that it does not protrude beyond the hoop of the drum. In addition, such dual hold provides more grip options and accessibility choices for the drummer.

Main body 101 may be varied from the embodiments shown in the diagrams. Main body 101 may take any shape and size. Main body 101 may also be expanded in size to accommodate additional stick slots, or made smaller. Main body 101, or entire holder 200 (or 100) may also have decorative cuts, holes, grooves, and the like. Main body 101, or entire holder 200 or 100 may also have decorative designs printed on it or be covered by an additional layer of material forming an outer layer or outer skin for either functional or decorative purposes.

Figure 8A:
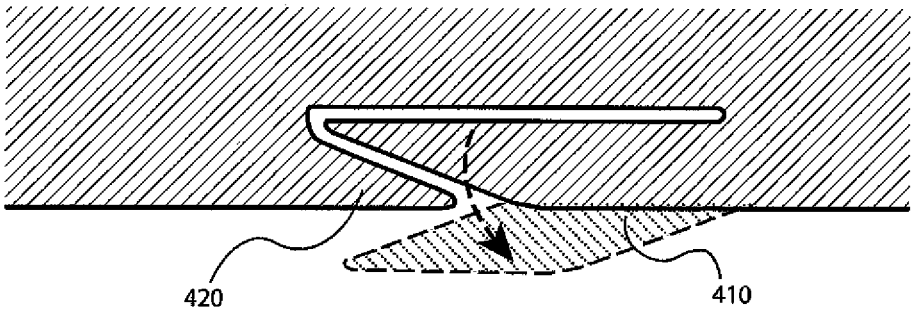
FIG. 8A through FIG. 8C are front plan views showing different implementations of alternatives that may be integrated into the holder to provide height and tilt adjustment.
Figure 8B:
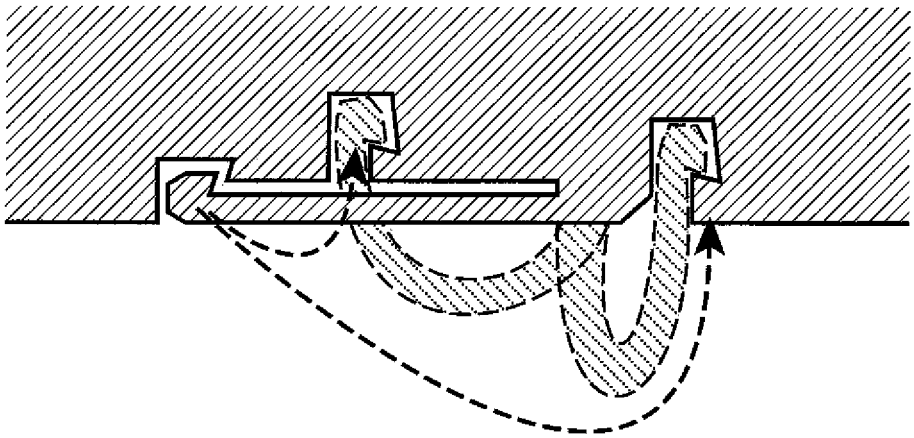
Figure 8C:
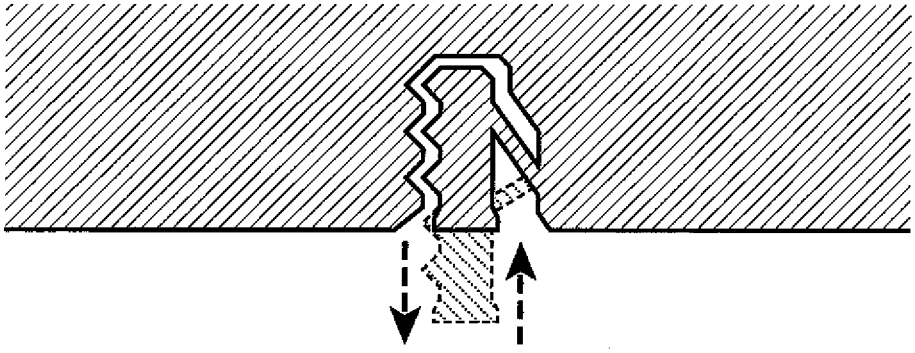

FIG. 8A through FIG. 8C are front views showing different implementations of alternatives that may be integrated into the holder to provide height and tilt adjustment. They may be positioned at various locations on the holder, such as, but not limited to, the bottom of the main body 101, which would typically be against the drum shell 320, or on the underside or bottom of the hoop ledge 201, which would be resting on the top or outer surface of the drum hoop 360.

Such adjustment structures may be implemented as single or multiple instances on a holder. The different alternatives may be used exclusively or mixed, whereby one alternative or multiple alternatives may be incorporated into the same holder and may be on the same or different parts of the holder at the same time.

FIG. 8A illustrates a cut section of pliable material, height and tilt adjustment flap 410, which may be pulled downward and away from the rest of the material block in such a way that due to its flexibility and the flexibility of the material around it, each is able to compress and flex in order to move out of the way of the other, allowing the elongated flap to partially free itself from its original location while still remaining attached on at least one surface to the rest of the material. After being pulled down, then released, it will expand from any compression resulting from the removal process and remain protruding and be blocked from immediate return by the remaining parts of material which will obstruct it, the height and tilt flap position stopper 420, after they expand back into place after the pulling removal process. This protruding material will act as a booster to raise the height, or tilt in some way, the block of material above it.

ALTERNATIVES: In addition to the alternatives already mentioned, many other modifications and embodiments are possible. As a result, there may be alternative ways that my drumstick holder can be implemented. Several are listed in this section, but there are innumerable others.

General Adjustments and Variations: Different materials, sizes, positions and interconnections may be used for all components.

More Stick Slot Options: Stick slots 110 may be different shapes, (such as narrower or shallower) at the front and/or back edges, of the main body 101, than in the middle. An advantage of this would be differing hold characteristics due to changes in the amounts and locations of friction. Another advantage may be a change in the angle of the stick or sticks as they sit in the holder. Length of stick slots 110 (from front to back) may also be varied.

Stick Slot Substitutes: Stick slots 110 may be augmented or replaced. For example, stick slots 110 may be replaced with clips, loops of material or other means of holding sticks such that these replacements may be positioned in a similar way to stick slots 110, or may be positioned differently, such as protruding from main body 101 in varying amounts, distances or heights. Such replacements may also protrude partially above main body 101, or may be entirely above main body 101.

Materials and Surface Textures: Various different materials could be used. Also, modifying surface textures of the entire holder or varying the textures of certain areas, or making them have no texture, would prove advantageous under certain situations and applications.

Mixed Materials: Mixing materials into an integrated whole, may be useful for some situations or select intended applications. For example, non-pliable portions with pliable portions inter-mixed or affixed. Similarly, a mixture of areas having varying amounts of rigidity or pliability may be employed.

Adaptations for Different Mounting Locations: Holder may have modified size and shape of any parts in order to fit onto, or mount onto, other types of drums, drum hardware and/or cymbals or cymbal hardware.

Mounting Wing Modifications: Mounting wings may be modified in innumerable ways. For example, they may be modified in size, shape, style, texture, material, pliability and location.

Mounting Wing Alternatives: Mounting wings may be replaced or substituted with other fastening or mounting methods. Such as, hook-and-loop fasteners, snaps, buttons, zippers, or rib or slot-slide closures, or other types of straps, buckles, or strings. Also, slots or glue may be used. Furthermore, thumbscrews, wing-nuts, pressure-slides, cam and lever mechanisms, and other similar methods may be used.

Added Bracket: my holder may be implemented with the addition of a bracket or adapter in order to mount to other locations, such as; drum rims, aka hoops, drum or cymbal stands, music stands, chairs, percussion tables, drum thrones, microphone stands or microphone stand tops.

Optional Position Lock Ridges: Depending on material used, generally how hard or soft (more pliable), the Positioning Lock Ridges 130 or notches, or grooves, or ripples may be unnecessary. Harder material tends to need notches, while softer material has less need for these ridges. That is, soft smooth material when pressed under a tension rod, readily forms around the tension rod in such a way that it creates its own areas that act as temporary ridges in the form of a depression under the tension rod and protruding areas rising up and surrounding the tension rod on either side.

Adhesives: Using adhesive glue, tape, etc. to achieve mounting, possibly in addition to or as a substitute for other mounting means, is possible. This may include hook-and-loop fastener strips used in several ways, including—but not limited to—adhering one side of a hook-and-loop strip to an intended mounting surface with the matching/mating hook-and-loop component or surface present on the holder, such that they may be pressed together to form a connection.

Additional Item Storage: An area for holding or storing more than just drumsticks, such as drum keys and other instrument related spare parts, may be added.

Hoop Ledge or "Lip": The addition (or rather a subtraction) of a cutaway (or, may be molded in) that protrudes at the typical height of a bass drum hoop and rests on that hoop provides more stability for the entire holder and provides other advantages, such as:

By allowing more depth of material, this provides extra length to the Stick Slots 110 creating increased stick stability.

Position and Height Options Influence Tilt—ledge position may be generally level with average hoop height, distance above, or, away from, shell, or, it may be slightly shorter than actual hoop height, in which case this disparity in height pushes the front of holder up a little so that sticks then tilt up slightly. As a result, sticks may be less likely to hit knees of drummer and are more likely to stay in holder than if level or tilted down, since the stick weight is focused more back into the holder rather than potentially down and away, out, from holder. On the other hand, making it higher than actual hoop height would result in forward tilt, angling sticks downward, as may be desirable for some users.

Double Hoop Ledge: The hoop ledge 201 feature may be duplicated such that it extends from both the front and back sides of the main body 101. This would have the advantage of further increasing the omnidirectional positioning or mounting nature of my drumstick holder and making the stick slots 110 longer to allow for increased hold stability and/or more hold options or variations to be introduced. Each of the two (2) hoop ledges may be a different height, thereby providing different tilt choices based upon which ledge would be facing or above the hoop. Additionally, the size of the stick slots 110 may be different at one hoop ledge 201 verses the other (on the opposite side of the main body 101), or stick slots 110 may be different as they pass through the area of both hoop ledges 201 compared to that of the same stick slots 110 as they pass through the main body 101. In this way, the hold characteristics may vary for a single stick slot 110 from front to back and back to front on the same holder 200. Such a stick slot 110, would have an increased stick diameter adjustment latitude and ability.

Inflatable: Some functionality of my invention may be implemented using inflatable shapes, filled with air, liquid, beads, grains or other substitutable or suitable substances. For example, filled shapes may be silicone gel packs.

Multi-Layered: Multiple layers of stick slots 110, or staggered alternating slot heights, are possible, such that height of stick slots, and thus held sticks, are at different distances from bottom of main body 101. The layers may hold sticks in a way that they are stacked but separate. So, some sticks, maybe an entire row or more of sticks, are positioned above other sticks all in the same holder.

Storage or Carrying Cases: My drumstick holder invention may also be implemented by incorporating it into storage, carriers, bags, cases and other similar items for drumsticks, or any other locations where it may be desirable to keep drumsticks. It may be internal or external to the location, or both. Similarly, my holder may be incorporated into or mounted in (or on) other locations, such as walls, cabinets, drawers, drum cases, cymbal cases, cymbal stands, drum hardware cases, drum pedals, drum thrones, drum pedal bags or cases, drum stands, drum racks, drum mounts, drum tables, and many more innumerable places. For drum cases, my invention may be adapted to accommodate alternative means of attachment or integration into the case and adapted to fit into the spaces of the case, such as by modifying the holder's proportions or otherwise scaling it accordingly.

Non-Percussion Applications: My invention may be used for various other applications and situations. It may be scaled for instrument bows (violin, viola, cello, etc.). Scaled for thinner items; such as timpani mallets, xylophone mallets, various thin percussion sticks, dulcimer sticks/mallets, conductor batons, and innumerable other items.

Pressure Release Channels: Pressure release or relieving channels, valleys, grooves, or slots may be incorporated. These optional valleys, or cut away areas, may be added around Stick Slots 110 to modify the pressure of a given Stick Slot by reducing material adjacent to the Stick Slot 110 such that the reduction of material allows the remaining material to expand away from a stick more easily, thus producing less pressure on the stick.

In other words, material may be removed to create additional slots or channels, or grooves, that may not be intended to hold sticks, but rather be in between the stick slots 110 such that they will allow the stick slots 110 to open more easily and widely by reducing the overall material surrounding a stick slot 110, thus relieving or reducing pressure on the sides or walls of a stick slot 110.

Modifiers: For various purposes—such as added support, reinforcement, flex modification or other reasons—beams, spars, ribs, dowels, rods, pieces, shells, segments, slats, wires or similar structures may be inserted through the pliable material in various directions and at various locations. Such components may also be added to the outer surface of the holder. Such added components may be composed of various materials, including but not limited to; metal, plastic, wood, cloth and more.

Additional Height and Tilt Angle Adjustments: There are numerous ways to implement adjustments for height and tilt angle, while maintaining the one-piece design. These methods may be combined in various ways. No tools are required to make these adjustments. In general, these methods fall into the following broad categories:

Shapes—by changing the slope of an underside surface, such as the Main Body 101 or the Hoop Ledge 201, from flat to angled, the angle of the entire holder may be made different. Variations on this theme may be:

Sloped Hoop Ledge 201 may be made whereby it increases the overall angle of the entire holder as it is pushed further over the drum hoop 360.

Double sloped—using dual Hoop Ledges 201 (one on each side) each with a different sloped angled underside, a user may alter the height or angle by turning the holder and using whichever surface gives the result they personally want.

Movable Pieces. They may be variously described as flaps, stems, bumps, blocks or other terms. These methods vary from the above shape approach in that they are movable whereas the shape changes are static. As such, the movable pieces have the advantage of being fully adjustable, thus they may be changed as needed including being reversible so that their adjustment may be eliminated, or re-set. Examples are shown in FIG. 8A through FIG. 8C They all share a generally similar approach, being parts that are cut or shaped in such a way to allow them to be moved independently from the whole. Then these can be generally grouped into two types; those having an uncut portion, allowing them to be tethered to the whole, or those that have continuous cuts allowing them to be pulled away so they may separate from the whole.

Flaps can be folded in or out, bent or folded in different directions and may be locked into various notches to form shapes with different amounts of protrusion, thus different heights or tilts. Flaps serve different functions such as to raise (or lower) entire holder or cause the holder to tilt. Function may be controlled by various factors, such as; location, placement, size, shape and angle of its surfaces (relative to the rest of the holder).

Tilting the holder would have the effect of changing the stick protrusion angle.

Flaps along the bottom of the Main Body 101 would raise the height, whereas flaps along the bottom of the hoop ledge 201 would cause the entire holder to tilt by raising the front portion only. Also, flaps may be cut in a way that is not at right angles to the Main Body 101 such that they provide both height and tilt functionality at the same time. Furthermore, the angle of cut for the cutout areas of the flap may be used in conjunction with other factors, such as location, to create combo flaps that change both height and tilt, possibly in different ways.

On The Spot and In-Place Adjustment: Furthermore, these adjustment methods would not require a user to remove the holder from its mounting location to make the adjustments. Adjustments could generally be made with holder mounted in place, with the possibility of requiring a modest twist of holder to do so which is easily accomplished due to its pliable and flexible nature.

Morphing Materials. There are a number of materials that change shape or size in response to the application of various outside forces, such as: moisture, temperature, electrical current, light, chemicals or other means.

For example, foam and sponge materials that expand with the simple application of moisture and stay expanded even after the moisture has dried. It may be possible to implement all or part (in a mixed material construction alternative) of my drumstick holder from these.

Flat Pack Segments: My drumstick holder invention may be implemented as at least two multiple thin slices, or cross-section segments, that may be assembled prior to use using methods such as, but not limited to, slotted cross-pieces which act as beams to hold the slices in position where there may be spaces between the slices. Such an implementation may have the appearance of a skeletal or framework assembly that may then be covered by an outer skin or remain uncovered.

Tubular Drumstick Holes: Holes, having various diameters and various shapes, may be added to my invention to hold sticks in the inner area of the Main Body 101, such that they are enclosed on all sides surrounding the stick, that is, not having any part of their diameter open or cut.

From the above, it may be understood that the present invention is a drumstick support system. The system includes a drum having a cylindrical drum shell 320 with a central axis and axially spaced opposed drum heads 325. The drum shell has a drum hoop 360 adjacent to each opposed drum head. A plurality of circumferentially spaced drum tension rods 340 are located around the drum hoops and parallel with the central axis. A drum hoop claw 350 and a drum lug 330 secure each tension rod in place radially spaced from the drum shell and the drum hoop.

A drumstick 310 is removably coupled to the drumstick holder for use with the drum.

A single continuous one-piece drumstick holder 100 has laterally spaced mounting wings 102 and a raised main body 101 between the spaced mounting wings. Each mounting wing terminates laterally in an insertion wedge end 120. The drumstick holder has lower interior surface and an upper exterior surface. The drumstick holder is fabricated of a resilient elastomeric material.

The interior surface of the drumstick holder is smooth and in a continuous curve about the central axis.

The exterior surface of the main body of the drumstick holder is formed of a plurality of stick slots 110. Each stick slot of the plurality of stick slots has a generally cylindrical configuration for between 260 and 280 degrees with an upwardly facing tapered opening. Each stick slot adapted to hold one drumstick 310.

The exterior surface of each mounting wing is formed with a planar tapered section adjacent to each insertion wedge end. The exterior surface of each mounting wing is formed with undulating positioning lock ridges 130 between the planar tapered sections and the main body. The exterior surface of each mounting wing is formed with a side notch 140 located between the main body and the lock ridges 130. The drumstick holder is removably coupled to the drum with the exterior surface of the drumstick holder in contact with two tension rods and with the interior surface of the drumstick holder in contact with portions of the drum hoop including any intermediate objects that may be supported by and in direct contact with the hoop, and with the interior surface of the drumstick holder being in contact with portions of the drum shell. The tapers of the opposed end sections are adapted to facilitate the releasable coupling of the drumstick holder to a drum. The positing lock ridges adapted to facilitate the retention of the drumstick holder to the drum.

The present invention includes alternate embodiments of the invention. As shown in FIG. 3, the system is formed with side edges between the end edges. The side edges are more widely spaced at the main body than at the mounting wings to thereby provide a hoop ledge 201 creating a greater surface area for supporting drumsticks.

FIG. 4 shows radial slots 110B in the stick slots to improve securement of a drumstick in a stick slot. Note also FIG. 5B.

The system further includes repositionable components selectively movable between an operative orientation and an stowed orientations so as to provide height and tilt adjustment for drumsticks being supported by the system. Note FIGS. 8A, 8B and 8C.

Lastly, the invention is a drumstick holder that is flexible wherein the drumstick holder may be compressed, such as hit with a hammer and run over by a car, and will recover to full functionality, and wherein the drumstick holder bounces and will not break if dropped and impacted in any way, and wherein the drumstick holder is comprised of pliable material that will spring and rebound back into shape after being hit and squashed.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A drumstick support system comprising:

a drumstick holder having laterally spaced mounting wings and a raised main body there between, each mounting wing terminating laterally in an insertion wedge end, the drumstick holder having an downwardly facing interior surface and an upwardly facing exterior surfaces;

the exterior surface of the main body being formed with a plurality of stick slots, each stick slot having a curved configuration with an upwardly facing opening; and the exterior surface of each mounting wing being formed with a tapered section adjacent to each insertion wedge end, the exterior surface of each mounting wing being formed with positioning lock ridges between the tapered sections and the main body.

2. The system as set forth in claim 1 and further including:

a drum having a cylindrical drum shell with a central axis and axially spaced opposed drum heads, the drum shell having a drum hoop adjacent to each opposed drum head, a plurality of circumferentially spaced drum tension rods located around the drum hoops and parallel with the central axis, a drum hoop claw and a drum lug securing each tension rod in place radially spaced from the drum shell and the drum hoop, the drumstick holder being removably coupled to the drum with the exterior surface of the drumstick holder in contact with the two tension rods and with the interior surface of the drumstick holder in contact with portions of the drum hoop including any intermediate objects supported by and in direct contact with the hoop, and with the interior surface of the drumstick holder being in contact with portions of the drum shell.

3. The system as set forth in claim 2 wherein the interior surface of the drumstick holder is curved about the central axis.

4. The system as set forth in claim 1 wherein the drumstick holder is fabricated in one piece of an elastomeric material.

5. The system as set forth in claim 1 wherein the stick slots each having a generally cylindrical configuration of between 260 and 280 degrees and with an upwardly facing tapered opening, each stick slot adapted to hold one drumstick.

6. The system as set forth in claim 1 wherein the exterior surface of each mounting wing is formed with a side notch (140) located between the main body and the lock ridges.

7. The system as set forth in claim 1 wherein the tapered section is formed with undulations parallel with the stick slots and the insertion wedge ends.

8. The system as set forth in claim 1 wherein the drumstick holder is formed with parallel side edges vertically oriented and extending between the end edges.

9. The system as set forth in claim 1 wherein the drumstick holder is formed with side edges between the end edges, the side edges being more widely spaced at the main body than at the mounting wings to thereby provide a hoop ledge (201) creating a greater surface area for supporting drumsticks.

10. The system as set forth in claim 1 and further including radial slots (110B) in the stick slots to improve securement of a drumstick in a stick slot.

11. The system as set forth in claim 1 and further including repositionable components selectively movable between an operative orientation and stowed orientations so as to provide height and tilt adjustment for drumsticks being supported by the system.

12. A drumstick support system comprising:

a drum having a cylindrical drum shell (320) with a central axis and axially spaced opposed drum heads (325), the drum shell having a drum hoop (360) adjacent to each opposed drum head, a plurality of circumferentially spaced drum tension rods (340) located around the drum hoops and parallel with the central axis, a drum hoop claw (350) and a drum lug (330) securing each tension rod in place radially spaced from the drum shell and the drum hoop;

a drumstick (310) removably coupled to the drumstick holder and for use with the drum;

a single continuous one-piece drumstick holder (100) having laterally spaced mounting wings (102) and a raised main body (101) between the spaced mounting wings, each mounting wing terminating laterally in an insertion wedge end (120), the drumstick holder having an interior surface and an exterior surface, the drumstick holder being fabricated of a resilient elastomeric material;

the interior surface of the drumstick holder being smooth and in a continuous curve about the central axis;

the exterior surface of the main body of the drumstick holder being formed of a plurality of stick slots (110), each stick slot of the plurality of stick slots having a generally cylindrical configuration of between 260 and 280 degrees with an upwardly facing tapered opening, each stick slot adapted to hold one drumstick (310); and the exterior surface of each mounting wing being formed with a planar tapered section adjacent to each insertion wedge end, the exterior surface of each mounting wing being formed with undulating positioning lock ridges (130) between the planar tapered sections and the main body, the exterior surface of each mounting wing being formed with a side notch (140) located between the main body and the lock ridges (130), the drumstick holder being removably coupled to the drum with the exterior surface of the drumstick holder in contact with two tension rods and with the interior surface of the drumstick holder in contact with portions of the drum hoop including any intermediate objects supported by and in direct contact with the hoop, and with the interior surface of the drumstick holder being in contact with portions of the drum shell, the tapers of the opposed end sections adapted to facilitate the releasable coupling of the drumstick holder to a drum, the positing lock ridges adapted to facilitate the retention of the drumstick holder to the drum.

* * * * *